US006134733A

United States Patent [19]

Tidei

[11] Patent Number: 6,134,733

[45] Date of Patent: Oct. 24, 2000

[54] OPERATING UNIT FOR THE MANUFACTURING OF SIDES FOR SHOE BOTTOMS

[75] Inventor: Agostino Tidei, Montelparo, Italy

[73] Assignee: Step di Tidei Agostino, Italy

[21] Appl. No.: 09/272,223

[22] Filed: Mar. 18, 1999

[30] Foreign Application Priority Data

Mar. 20, 1998 [IT] Italy ..... BO98A0179

[51] Int. Cl.[7] ..... A43D 21/00

[52] U.S. Cl. ..... 12/85; 12/78; 12/86.5; 12/92

[58] Field of Search ..... 12/70, 77, 78, 12/77.5, 92, 85, 86.5, 86.6, 87, 88, 86.65

[56] References Cited

U.S. PATENT DOCUMENTS

| | | | |
|---|---|---|---|
| 438,997 | 10/1890 | Fowler et al. . | |
| 974,422 | 11/1910 | Pease . | |
| 1,162,438 | 11/1915 | Beaudry . | |
| 1,174,042 | 3/1916 | Bates . | |
| 2,162,141 | 6/1939 | Vest | 12/92 |
| 3,255,477 | 6/1966 | Smith et al. | 12/92 |
| 4,756,038 | 7/1988 | Stein . | |

FOREIGN PATENT DOCUMENTS

| | | |
|---|---|---|
| 2 532 236 | 3/1984 | France . |
| 1162232 | 1/1964 | Germany . |
| 25 18 314 | 11/1975 | Germany . |
| 43 35 886 C1 | 6/1995 | Germany . |
| 279984 | 6/1927 | United Kingdom . |

OTHER PUBLICATIONS

Annex to the European Search Report on European Patent Application No. EP 99 83 0138.

*Primary Examiner*—M. D. Patterson
*Attorney, Agent, or Firm*—Leonard Bloom

[57] ABSTRACT

A machine for finishing the sides of the bottoms of footwear has an endless abrasive belt carried by a pair of rollers, including a driving roller and an idler or drive roller. The driving roller is connected to a power-driven oscillating head on the machine, and the driven roller has an articulated connection to the machine.

8 Claims, 3 Drawing Sheets

OPERATING UNIT FOR THE MANUFACTURING OF SIDES FOR SHOE BOTTOMS

SUMMARY

The invention concerns an operating unit associated to a machine for the manufacturing of sides for shoe bottoms.

The operating unit comprises an oscillating head, which supports a tool-holder assembly able to slide horizontally with respect to the head in opposition with elastic members.

Operating Unit for the Manufacturing of Sides for Shoe Bottoms

The invention relates to the technical sector of machines for the footwear industry, with particular reference to the machines used for the manufacturing of shoe bottoms.

In many instances the bottoms—such as the ones made of rubber or similar synthetic material—are slightly milled on the sides to eliminate any molding burrs and give the machined surface a particular aesthetic look before they are assembled on the upper.

Automatic bottom milling machines are already known on the market, such as the machine described in the application No. B096A000155 registered in the name of the Applicant.

In these machines the bottom comes into contact with an abrasive tool which rotates at a high speed. By means of suitable means the tool follows the bottom profile to carry out the milling on the entire side of the bottom. The quality of the milling mostly depends on the tool pressure on the material, which must be suitable and as constant as possible in the various parts of the bottom.

It may be difficult to achieve this condition, due to the differences in size and/or shape that can exist between the various pieces of the same type of bottom, which do not correspond to the profile memorized by the machine to control the means used to move the bottom and/or tool.

Another operating requirement of the above manufacturing is represented by the need of varying the position of the tool on the vertical plane, in order to follow the corresponding inclinations of the machined surface. The purpose of the invention is to propose an operating unit which can be associated to a machine for the manufacturing of sides of shoe bottoms, able to provide a constant pressure of the tool on the material within an operating range that is wide enough to compensate the possible differences in size and/or shape of the bottom compared to the imaginary profile memorized in the machine.

A further purpose of the invention is to propose an operating unit provided with members used to change the position of the tool on the vertical plane and moved by corresponding means located in the machine.

The characteristics of the invention are illustrated in the following description which refers to a possible embodiment of the operating unit, according to the contents of the claims and with reference to the enclosed drawings whereby:

Figure 2:
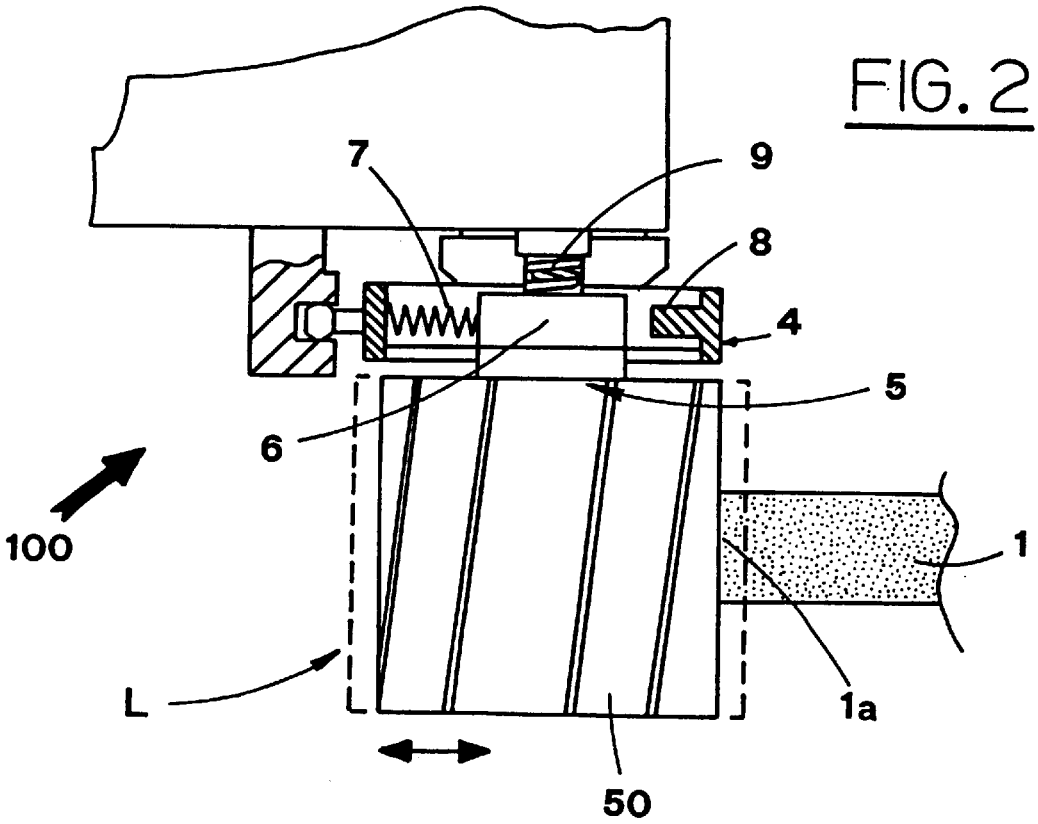
FIG. 2 is the same as FIG. 1, with the unit in operating condition.
Figures 3A, 3B:
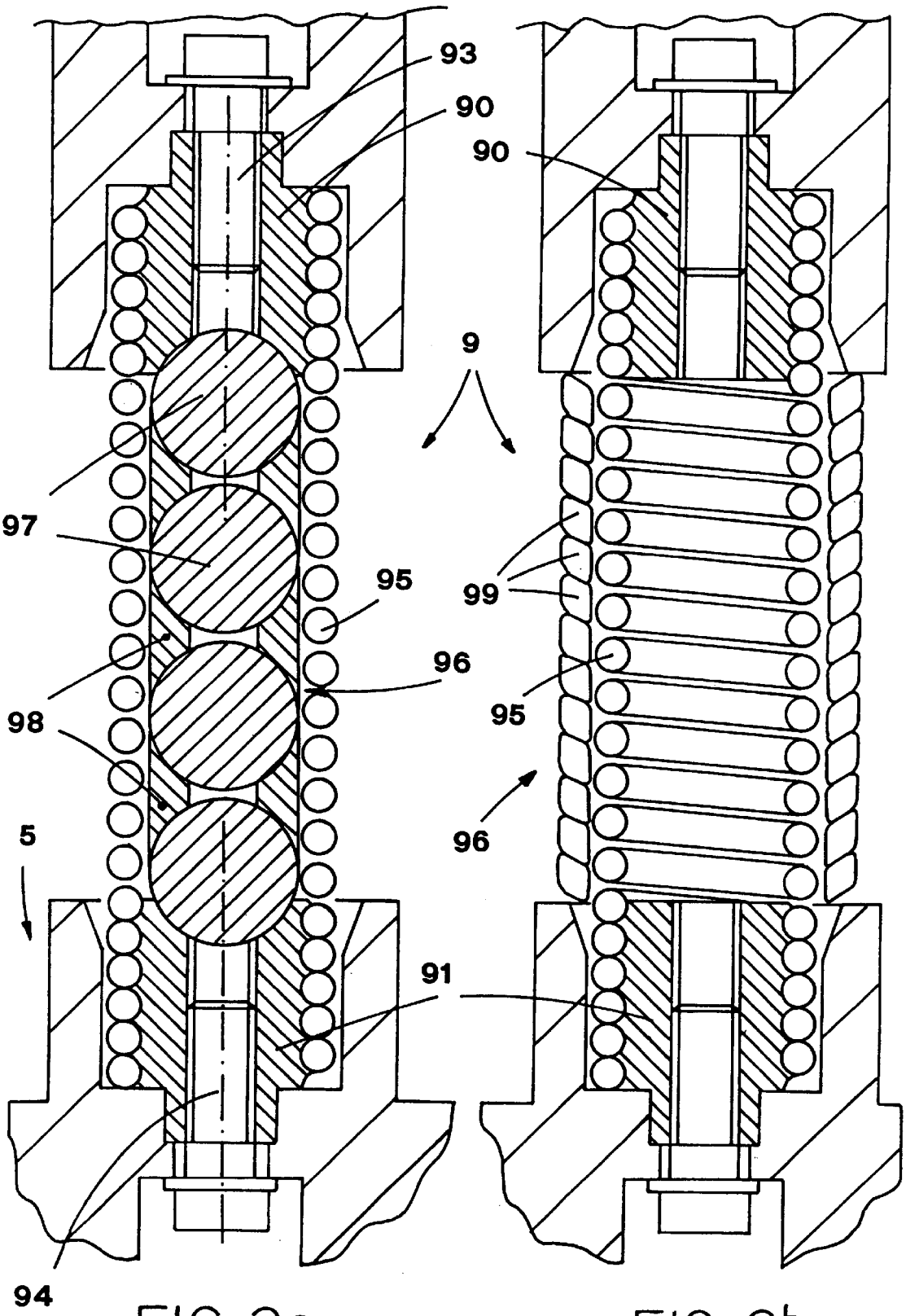
Figure 4:
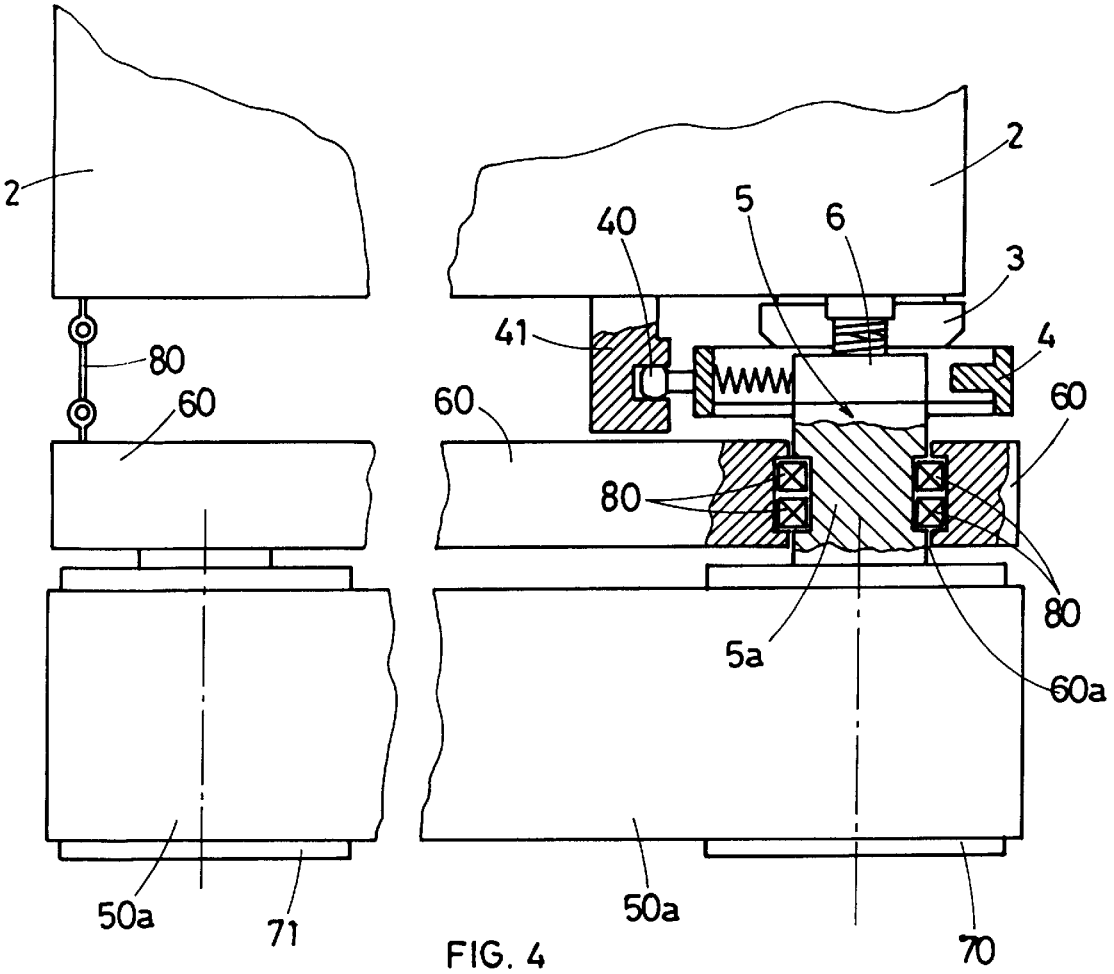

FIGS. 3*a* and 3*b* are enlarged views of longitudinal sections of a constructive detail of the unit, according to two construction versions;

FIG. 4 is the same as FIG. 2, but refers to a different constructive version of the operating unit according to the invention, which uses an annular tape of abrasive paper, instead of a grinding wheel, as indicated in the version as per FIG. 2.

Figure 1:
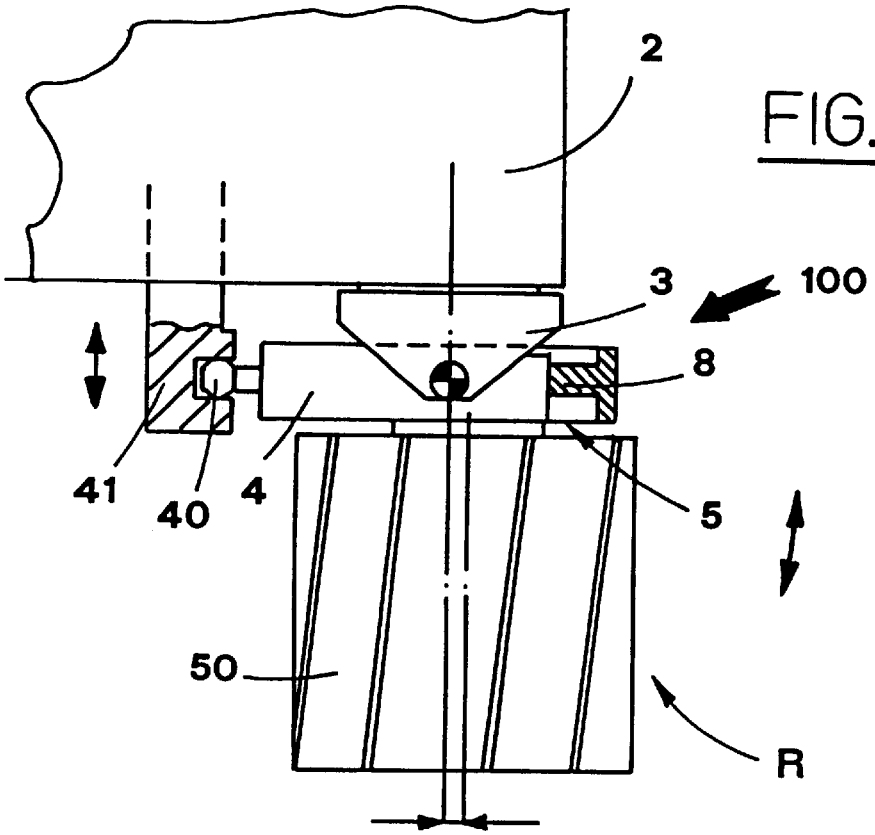
FIG. 1 is a side view of the operating unit, with some sectioned parts, in rest position.

With reference to FIGS. 1 and 2, 100 indicates the operating unit comprising a tool—which in this case is represented by a grinding wheel 50 abrasive member of known type—for the milling of the sides 1*a* of shoe bottoms 1. The operating unit 100 is designed to be associated with a known machine 2 (not detailed) provided with power means for the rotation of the splining hub 5*a* of the tool 50 and with suitable means to determine, together with the splining hub, the operative cycle for the complete manufacturing of the sides 1*a*, in order to eliminate possible molding burrs and give a pleasant aesthetic look to the surface.

Apart from the above tool 50, the operating unit 100 is composed of a bracket 3 used to fix the unit 100 to the machine 2, of an oscillating head 4 and of a tool-holder assembly 5.

The oscillating head 4 is hinged to the bracket 3 with perpendicular axis with respect to the rotation axis of the tool 50 and includes maneuvering members 40 which, in the example herein illustrated, consist in a pin with spherical head, fixed to a fork 41 associated to the machine.

The fork 41 is linked up to control means (not illustrated) which determine the preset position of the oscillating head 4 by raising or lowering the fork 41, as described in detail below.

As it is known—but not illustrated herein—the tool-holder assembly 5 includes the said hub 5*a* used to spline the tool 50 and is supported by the oscillating head 4 by means of sliding parts 6 able to permit the rectilinear transfer, mainly horizontal, on the same oscillation plane as the head 4. The oscillating head 4 houses elastic members 7 which actuate on the tool-holder assembly 5 in order to maintain it in the rest position R defined by the stop 8 (FIG. 1).

Finally, the unit 100 includes a transmission coupling 9 located between the power means of the machine 2 and the tool 50, which permits the off-centering between the power means and the tool 50, as a result of the oscillation of the head 4 and/or the movement of the tool-holder assembly 5. In the preferred embodiment illustrated in FIGS. 3*a* and 3*b*, the coupling 9 is composed of two ends 90, 91, which are removably blocked with screws 93, 94 to the driving shaft of the power means and to the hub of the tool-holder assembly 5, respectively.

The ends 90, 91 are suitably threaded on the outside in order to fix and block the end of an helical spring 95, which is located between the ends for their mutual connection.

The coupling 9 also includes a flexible sleeve 96 able to hinder the diameter variations induced by the stress caused by the resisting couple during the rotation of the tool 50.

In the example illustrated in FIG. 3*a*, the rotation direction of the tool 50 is opposite to the winding direction of the coils of the spring 95 and therefore the spring tends to contract. In this case the flexible sleeve 96 is situated inside the spring 95 and composed, for instance, of a variety of spheres 97 alternated with spacers 98 featuring suitable spherical cavities in the area of contact with the spheres.

In the example illustrated in FIG. 3*b*, the rotation direction of the tool 50 is the same as the winding direction of the coils of the spring 95 and therefore the spring tends to expand. In this case the flexible sleeve 96 is inserted onto the spring 95 and composed, for instance, of a series of rings 99 featuring a suitably radial profile in the contact areas to allow for mutual articulation. During the operation of the operating unit 100, the tool 50 comes into contact with the side 1*a* of the bottom 1, with enough pressure to win the resistance of the elastic members 7, thus moving the tool-holder assembly 5 from the rest position R to the working position L, situated in a practically middle position of the total distance traveled by the tool-holder assembly 5 (FIG. 2). In this situation the pressure of the tool 50 on the material is determined by the elastic reaction of the members 7 and remains constant while the tool follows the profile of the bottom 1, also in presence of differences in size or shape compared to the profile memorized by the machine to control the means used to move the bottom and/or the tool. As a matter of fact, these differences are "absorbed" by the movement of the tool 50, which, by means of the elastic members 7, automatically adjusts its position.

The working characteristics described above do not change, regardless of the position of the tool 50 determined by the oscillation of the head 4, controlled by the fork 41 according to the inclination of the side 1*a* of the bottom 1.

In the example illustrated in FIG. 4, the operating unit 100 is designed to use an annular tape of abrasive paper 50*a*, comprising an endless abrasive belt instead of a grinding wheel 50.

This version comprises an arm 60 located immediately below the oscillating head 4 provided with a hole or bore 60*a* in which the hub 5*a* of the tool-holder assembly 5 is inserted.

The motor roll (70) constituting the driving roller around which the tape of abrasive paper 50*a* is wound is splined on the hub and the tape of abrasive paper 50*a* is wound around a second idle roll (71) constituting the driven idler roller supported by the other end of the arm 60. Bearings 80 are located between the arm 60 and the hub 5*a*, whereas articulated connection means are located between the arm 60 and the machine 2, in order to allow the arm 60 to follow the movements of the sliding members 6 and to take the angle imposed by the oscillating head 4, but not to rotate jointly with the assembly 5 which receives different orientations with respect to the side of the side 1*a* of the bottom 1, according to a preset operating cycle, as described above.

In absence of the articulated connection means 80, the arm 60 would be free to follow the orientation given to the assembly 5 causing a continuous, disturbing and dangerous waving of the shaft 60 rightward or leftward.

The advantageous characteristics of the operating unit 100 appear now evident, since they allow for high-quality manufacturing also in the case of non-identical bottoms.

As regards the possible constructive solutions, it must be said that the presence of elastically sliding masses is minimized, thanks to the flexible coupling 9 which allows for using relatively "soft" elastic members 7, thus obtaining a high working and adjusting sensitivity of the tool position. It must be however said that all the above is intended for purposes of illustration and not in a limiting sense. Therefore, possible modifications of the constructive details must be considered as included in the same protective scope, as described and claimed below.

What is claimed is:

1. In a machine for finishing the sides of the bottoms of footwear, wherein a power-driven oscillating head is applied to the sides of the footwear bottoms, the improvement which comprises a driving roller connected to the oscillating head, an idler roller, an articulated connection between the idler roller and the machine, and an endless abrasive belt over the driving and idler rollers.

2. The improvement of claim 1, further including an arm disposed between the oscillating head and the driving roller, the arm having a bore, a bearing in the bore, a hub journaled in the bearing, the hub connecting the oscillating head and the driving roller, and the arm carrying the idler roller and having the articulated connection with the machine.

3. A machine 2 for the manufacture of sides 1*a* of shoe bottoms 1, comprising a bracket 3 on the machine, an operating unit 100 mounted to the bracket, the operating unit 100 having a rotating hub 5*a* driven about an axis of rotation by a power means in the machine, the operating unit 100 further having an oscillating head 4 hinged to the bracket 3 about an axis perpendicular to the axis of rotation, the oscillating head 4 including a member 40 within a fork 41, oscillating unit 100 further including a tool holder assembly 5 and at least one sliding part 6, at least one elastic member 7 opposing the sliding part 6, a tool 50 driven by the tool holder assembly 5 and engaging the side 1*a* of the shoe bottom 1 between an at rest position R and a working position L, the tool 50 being connected to the power means in the machine 1 by a transmission coupling 9, thereby accommodating the movement of the oscillating head 4, characterized in that the tool comprises an endless abrasive belt 50*a*, an arm 60 disposed below the oscillating head 4, the arm 60 having a hole 60*a* provided with bearings 80 for rotatably journaling the hub 5*a*, a roller 70 carried by the hub 5*a* for driving the belt 50*a*, a second idle roller 71 supported by the arm 60 and receiving the belt 50*a*, and an articulated connection means 80 between the arm 60 and the machine 2, whereby the arm 60 follows the movements of the sliding part 6 and accommodates the angle imposed by the oscillating head 4 without conjoint rotation with the assembly 5.

4. The machine according to claim 1, characterized in that the transmission coupling 9 has two ends 90, 91, the ends 90,91 being joined to the power means and to the tool holder assembly 5, respectively, a first helical spring 95 between the ends 90, 91, and a flexible sleeve 96 accommodating the diametrical variations of the spring 95.

5. The machine according to claim 4, characterized in that the ends 90, 91 are externally threaded, and the first helical spring 95 has respective ends which are screwed on to the externally-threaded ends 90, 91 of the coupling 9.

6. The machine according to claim 4, characterized in that the flexible sleeve 96 is disposed within the spring 95, the spring 95 having coils wound in the opposite direction with respect to the rotation of the tool.

7. The machine according to claim 6, characterized in that the flexible sleeve 96 comprises a plurality of spheres 97 and spacers 98 disposed alternatively with respect to the spheres 97, the spacers 98 having spherical cavities in the area of contact with the respective spheres 97.

8. The machine according to claim 4, characterized in that the flexible sleeve 96 is disposed over the spring 95 and comprises a series of rings 99.

* * * * *

UNITED STATES PATENT AND TRADEMARK OFFICE

CERTIFICATE OF CORRECTION

PATENT NO. : 6,134,733
DATED : October 24, 2000
INVENTOR(S) : Tidei

It is certified that error appears in the above-identified patent and that said Letters Patent is hereby corrected as shown below:

Column 1,
Line 4, delete "SUMMARY" and substitute therefor -- DESCRIPTION OF THE INVENTION --.
Lines 5-11, delete in its entirety.

Signed and Sealed this

Thirty-first Day of July, 2001

*Attest:*

Nicholas P. Godici

NICHOLAS P. GODICI
*Acting Director of the United States Patent and Trademark Office*

*Attesting Officer*